US009499963B2

(12) United States Patent
Ceru et al.

(10) Patent No.: US 9,499,963 B2
(45) **Date of Patent: *Nov. 22, 2016**

(54) UNDER-SINK WASTE PROCESSING APPLIANCE

(71) Applicant: Whirlpool Corporation, Benton Harbor, MI (US)

(72) Inventors: Scott J. Ceru, Stevensville, MI (US); Andrew Deakin, Oakland, CA (US); Suzanne G. Howard, San Francisco, CA (US); Martin J. Kay, San Francisco, CA (US); Peter Riering-Czekalla, Oakland, CA (US); Altay J. Sendil, Palo Alto, CA (US); Casey J. Tubman, Benton Harbor, MI (US); Jennifer M. Devine, Cincinnati, OH (US); Jamesina A. Fitzgerald, Trenton, OH (US); Alice J. Michels, Cincinnati, OH (US); Russell L. Speiller, Montgomery, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 406 days.

This patent is subject to a terminal disclaimer.

(21) Appl. No.: 14/152,200

(22) Filed: Jan. 10, 2014

(65) Prior Publication Data

US 2014/0117126 A1 May 1, 2014

Related U.S. Application Data

(63) Continuation-in-part of application No. 13/916,811, filed on Jun. 13, 2013, now abandoned, which is a continuation of application No. 13/326,804, filed on Dec. 15, 2011, now Pat. No. 8,464,970, which is a continuation of application No. 12/643,171, filed on Dec. 21, 2009, now Pat. No. 8,100,352.

(51) Int. Cl.
*B02C 23/36* (2006.01)
*E03C 1/266* (2006.01)

(52) U.S. Cl.
CPC ..... *E03C 1/2665* (2013.01); *B02C 23/36* (2013.01)

(58) Field of Classification Search
CPC ..... B02C 23/36; E03C 1/2665
USPC ..... 241/21, 46.014, 100
See application file for complete search history.

(56) References Cited

U.S. PATENT DOCUMENTS

| | | | |
|---|---|---|---|
| 3,874,006 | A | 4/1975 | Ritter |
| 4,761,235 | A | 8/1988 | Haentjens |
| 4,847,927 | A | 7/1989 | Blanc |
| 5,127,587 | A | 7/1992 | Johnson |
| 5,129,590 | A | 7/1992 | Shinya |
| 5,176,825 | A | 1/1993 | Hadjis et al. |
| 5,413,705 | A | 5/1995 | Tammera et al. |
| 5,773,281 | A | 6/1998 | Ichikawa et al. |
| 5,806,413 | A | 9/1998 | Trovinger |
| 6,258,594 | B1 | 7/2001 | Nakaya |
| 6,413,435 | B1 | 7/2002 | Kyles et al. |
| 6,576,140 | B1 | 6/2003 | Batten |
| 6,629,652 | B2 | 10/2003 | Batten |
| 7,108,209 | B2 | 9/2006 | Kim |

(Continued)

*Primary Examiner* — Mark Rosenbaum

(57) ABSTRACT

An under-sink waste processing appliance includes a waste separator which extracts liquid from organic waste and a composting aid and passes such extracted liquid to a residential drain line. The remaining solid, in the form of organic pulp, is dried in a dryer and deposited in a removable collection receptacle.

19 Claims, 5 Drawing Sheets

(56) References Cited

U.S. PATENT DOCUMENTS

| | | | | |
|---|---|---|---|---|
| 8,100,352 | B2 * | 1/2012 | Ceru | E03C 1/2665 241/100 |
| 8,464,970 | B2 * | 6/2013 | Ceru | E03C 1/2665 241/100 |
| 8,474,374 | B2 | 7/2013 | Trovinger | |
| 2007/0113329 | A1 | 5/2007 | Luk | |
| 2007/0113335 | A1 | 5/2007 | Luk | |
| 2007/0289058 | A1 | 12/2007 | Luk | |
| 2009/0064875 | A1 | 3/2009 | Trovinger | |

* cited by examiner

UNDER-SINK WASTE PROCESSING APPLIANCE

CROSS REFERENCE TO RELATED APPLICATION

This application is a continuation in part of U.S. patent application Ser. No. 13/916,811, filed Jun. 13, 2013, which is a continuation of U.S. Pat. No. 8,464,970, filed Dec. 15, 2011, which is a continuation of U.S. Pat. No. 8,100,352, filed Dec. 21, 2009, all of which are incorporated herein by reference in their entirety.

TECHNICAL FIELD

The present disclosure relates generally to waste processing appliances for use in a kitchen.

BACKGROUND

Operation of a domestic kitchen produces organic waste such as food scraps. Such waste is generally either thrown into a trash receptacle or passed through a garbage disposal located under the kitchen's sink. Some jurisdictions do not allow the use of garbage disposals with only unprocessed waste (i.e., uncut) being permitted in the municipal drain lines.

SUMMARY

An under-sink waste processing appliance is herein described. The appliance mixes organic waste with a composting aid, extracts liquid from the organic waste, and passes such extracted liquid to a residential drain line. The remaining solid, in the form of organic pulp, is dried and deposited in a removable collection receptacle.

According to one aspect, a method for processing organic waste from a kitchen sink includes advancing organic waste through a drain of the kitchen sink and into a waste separator positioned below the kitchen sink. The waste separator is provided with a composting aid. A motor-driven cutter positioned in the waste separator is operated to generate pulp and a separated liquid from the organic waste. The pulp is advanced from the waste separator to a dryer. The separated liquid is drained from the waste separator to a drain via a fluid path which bypasses the dryer. The pulp is heated in the dryer to form a dried solid waste.

According to another aspect, a method for processing organic waste from a kitchen sink includes advancing organic waste through a drain of the kitchen sink and into a waste separator positioned below the kitchen sink. The waste separator is provided with a composting aid. A motor-driven cutter positioned in the waste separator is operated to generate pulp and a separated liquid from the organic waste. The pulp is advanced from the waste separator to a dryer. The separated liquid is drained from the waste separator to a drain via a fluid path which bypasses the dryer. The pulp is heated in the dryer to form a dried solid waste. The composting aid includes a first composition and a second composition.

BRIEF DESCRIPTION OF THE DRAWINGS

The detailed description particularly refers to the following figures, in which.

DETAILED DESCRIPTION OF THE DRAWINGS

Figure 1:
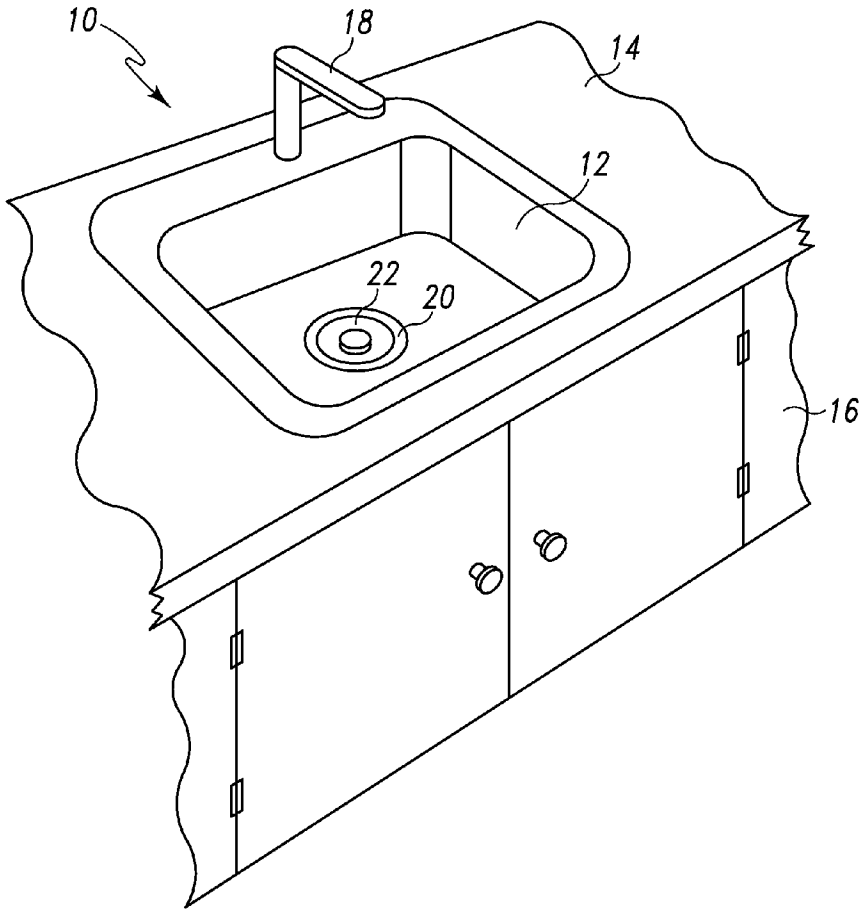
FIG. 1 is fragmentary perspective view of a kitchen sink installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a domestic kitchen 10 such as the type found in a residential home. The domestic kitchen 10 includes a number of kitchen cabinets 16 which support a counter top 14 secured to the top thereof. A kitchen sink 12 is positioned in the counter top 14 in a conventional manner. A faucet 18 is operable to fill the kitchen sink 12 with water. Water exits the kitchen sink 12 through a drain 20. As can be seen in FIG. 1, a drain cap 22 maybe used to prevent water from draining out of the sink 12 and into the drain 20.

Figure 2:
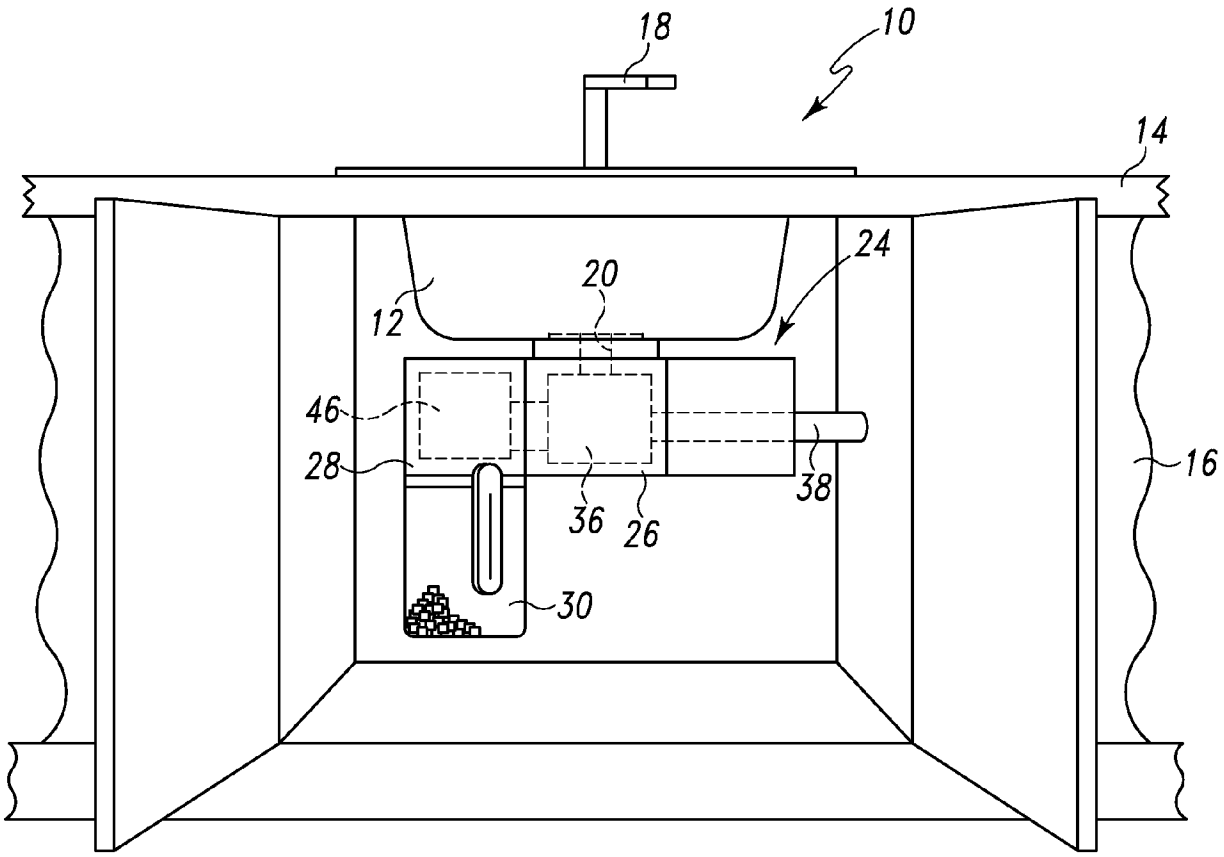
FIG. 2 is a fragmentary perspective view of a waste processing appliance installed under the sink of FIG. 1
Figure 3:
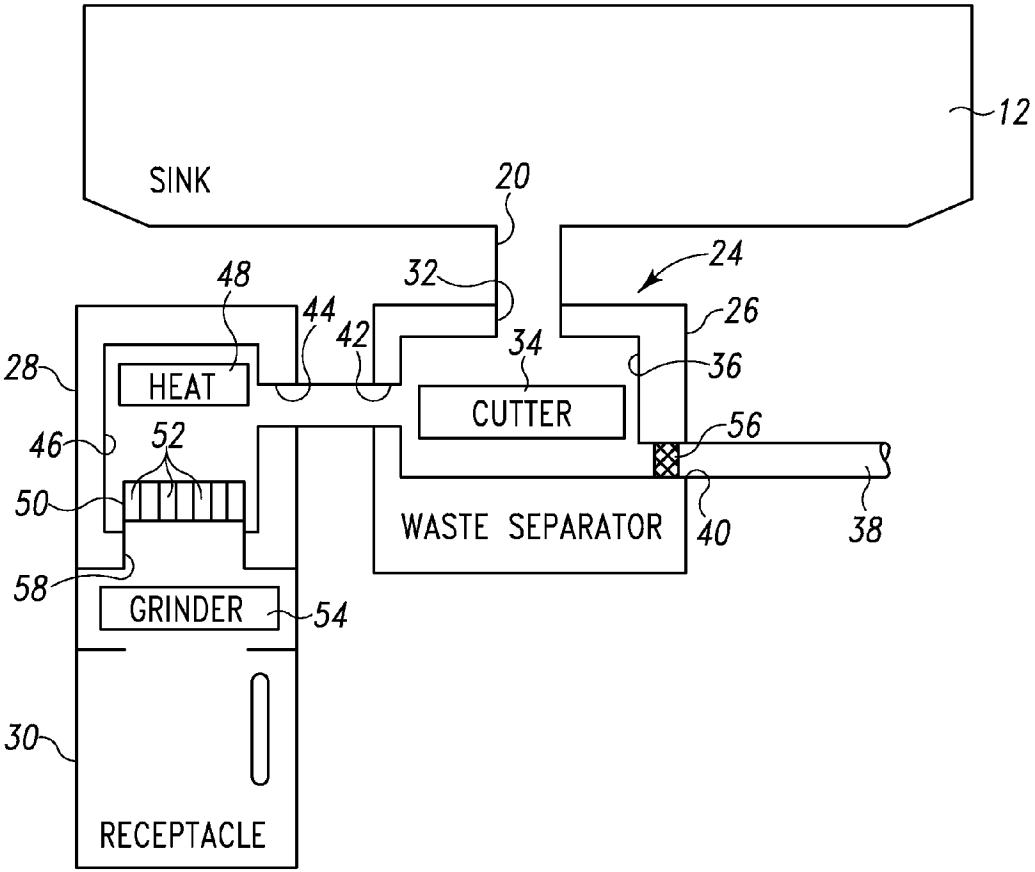
FIG. 3 is a block diagram of the waste processing appliance of FIG. 2.

Organic waste, such as kitchen scraps, and composting aids may also be flushed through the drain 20 and thereafter processed by a waste processing appliance 24 as shown more clearly in FIGS. 2 and 3. As can be seen in FIG. 2, the waste processing appliance 24 includes three primary components, the first of which is a waste separator 26. The waste separator 26 is operable to process organic waste and composting aids passed through the drain 20 of the kitchen sink 12 such that the organic waste is mixed with the composting aid to form an organic waste composition and liquid is extracted therefrom and dispelled to a municipal drain 38. The pulp formed from the separated organic waste composition is advanced to the second primary component of the appliance, a dryer 28. The dryer 28 dries the organic waste composition pulp and thereafter dispels it in the form of dried organic waste composition to the remaining primary component of the appliance, a removable collection receptacle 30.

As noted above, processing of the organic waste by the appliance 24 starts when the organic waste and composting aid (and presumably some amount of water from the faucet 18) is advanced through the sink's drain 20 and into a waste inlet 32 (see FIG. 3) of the waste separator 26. The organic waste and composting aid may either be advanced simultaneously or separately. A motor-driven cutter is operable to mix, cut, or otherwise process the organic waste and composting aid received through the waste inlet 32. The motor-driven cutter 34 may be positioned in a cutting chamber 36 of the waste separator 26. The waste separator 26 functions in a similar manner to a juicer appliance. Namely, the waste separator 26 cuts and squeezes organic waste to separate out the liquid from the waste, and, in doing so, mixes the composting aid with the organic waste and forms a pulp. The separated liquid (along with any water from the faucet 18 drained from the sink 12) is drained to a residential drain line 38 through a liquid outlet 40. The separated pulp is dispelled through a pulp outlet 42 in the direction toward the dryer 28. A filter 56 prevents solids from escaping the waste separator 26 through the liquid outlet 40 and into the drain line 38.

As can be seen in FIG. 2, the pulp outlet 42 and the liquid outlet are fluidly isolated from one another. As used herein, the term "fluidly isolated" means that the two outlets form different paths such that matter advancing through one port is prevented from passing through the other. As such, liquids (e.g., liquids separated from the organic waste composition or water) passing through the liquid outlet 40 are advanced along a fluid path that does not pass through the pulp outlet 42 (i.e., it bypasses the pulp outlet 42). Similarly, pulp dispelled through the pulp outlet 42 does not pass through the liquid outlet 40. In the case of the waste processing appliance 24, this is accomplished by the use of separate outlets (i.e., the liquid outlet 40 and the pulp outlet 42), both of which lead away from the cutting chamber 36. This is distinct from designs where, for example, both solids and liquids pass through a common outlet and are subsequently separated by filtration.

As alluded to above, the cutting mechanism of the waste separator may leverage concepts similar to those used in domestic juicers. In such a way, the waste separator cuts and squeezes organic waste composition and composting aid to mix the organic waste composition and separate out the liquid and in doing so forms a pulp not unlike a domestic juicer cuts and squeezes fruit to produce fruit juice and waste pulp. As such, the motor-driven cutter 34 may be embodied to include one or more augurs operable to cut and squeeze the organic waste composition thereby extracting the liquid from the organic waste composition and generating organic pulp. Alternatively, the motor-driven cutter 34 may include one or more centrifugal cutting discs which are operable to cut the organic waste composition and separate the liquid from it thereby generating organic pulp. Examples of augur-type cutting blades that may be used as the motor-driven cutter 34 (with or without some modification thereof) are found in U.S. Pat. No. 5,806,413 and U.S. Patent Application Publication No. 2009/0064875, now U.S. Pat. No. 8,474,374, both of which are hereby incorporated by reference. Other examples of augur-type cutters and centrifugal cutting disc-type cutters are found in numerous different designs of juicers.

The pulp outlet 42 of the waste separator is coupled to a pulp inlet 44 of the dryer 28. Organic pulp generated by the waste separator 26 advances through a pulp inlet 44 and into a drying chamber 46. A number of electric or gas heating elements 48 are operable to dry the organic pulp so as to generate solid organic waste. Once sufficiently dehydrated, the dried solid organic waste is advanced out of the drying chamber 46 via a waste outlet 58 and into the removable collection receptacle 30. It should be appreciated that the organic waste is subjected to a time and temperature within the drying chamber 46 such that it is sufficiently dehydrated beyond the point to support bacterial decomposition. In other words, the waste is dried sufficiently to prevent the organic waste from composting in the removable collection receptacle 30 thereby preventing unpleasant odors from being created.

One or more molds 50 may be positioned in drying chamber 46. Upon entry into the drying chamber 46, the organic pulp may be dispersed into the cavities 52 of the mold 50 and thereafter dried by operation of the heating elements 48. In such a way, dried waste plugs are produced and deposited into the removable collection receptacle 30.

Alternatively, or in addition to the use of the mold 50, a grinder 54 may be positioned in the drying chamber 46 or at a location between the drying chamber 46 and the removable collection receptacle 30. The grinder 54 may be used to powderize the dried organic waste (i.e., generate powder waste). In the case in which the grinder 54 is used in conjunction with the mold 50, the appliance 24 may be selectively operated to produce either plugs or powder much in the same way a domestic ice maker may be operated to produce either cubed or crushed ice. If the mold 50 is not used, the entirety of the dried organic waste is ground to powder prior to being advanced into the removable collection receptacle 30.

In operation, the waste processing appliance 24 is used to process organic waste, such as kitchen scraps, in a manner which mimics the ease of use of a conventional garbage disposal, but without passing solid wastes down a municipal drain line. This is especially useful in certain jurisdictions where the passage of processed (e.g., chopped) solid waste is prohibited by law. Moreover, the dried organic waste produced by the appliance 24 can be easily disposed of by either placing it in the garbage collection process, or, advantageously, using it as a compost material in a garden or flower bed.

In operation, a user places organic waste in the kitchen sink 12. The user may also place a composting aid in the kitchen sink 12. The composting aid may comprise activated carbon, which includes any form of carbon that can absorb odor. Non-limiting examples of activated carbon include activated charcoal, activated coal, and biochar. Activated carbon can mitigate malodor that can result from composting organic waste, however, too much activated carbon can negatively impact the pH balance of the composting system.

In one embodiment, the composting aid is a composition comprising from about 1% to about 100% activated carbon, preferably 50% to 100%, most preferably 80% to 99% of activated carbon. The composition may also contain other ingredients such as a plasticizer, microbes (suitable for composting), microbe supplements, enzymes, or combinations thereof. In one embodiment, the composition contains about 1 g to about 1000 g of activated carbon, alternatively about 25 g to about 500 g, alternatively about 50 g to about 250 g. The exact amount of activated carbon may depend on the amount of organic waste to be processed.

The composition may be a liquid, slurry, gel, powder, granular, or combination thereof. In one embodiment, the composition may be contained in an article comprising 2, 3, or more compartments such that different compositions may be contained within the compartments. In one embodiment, a first compartment may contain activated carbon, and a second compartment may contain a second composition, which may be free or substantially free of activated carbon. An article with multiple compartments may provide advantages such as separating incompatible ingredients or ease of dosing.

In another embodiment, the composting aid comprises a fertilizer composition for the beneficial result of improving the fertilization capabilities of the processed organic waste. Fertilizer compositions typically contain nitrogen and also preferably contain phosphate and potassium. Fertilizers may be designated by the content of one or more of these components. The contents of these components in a fertilizer may be indicated by the N-P-K value (wherein N=nitrogen content by weight percentage, P=phosphorus content by weight percentage, and K=potassium content by weight percentage). The appropriate N-P-K value depends upon the fertilizing application, which is in turn generally dedicated by the needs of the plant and/or soil conditions for which the processed organic waste will be used. For example, a general purpose fertilizer will contain a weight ratio of 12-12-12 of N-P-K respectively, or 12 wt % nitrogen, 12 wt % phosphorus, and 12 wt % potassium. The remaining components are typically filler.

According to certain non-limiting embodiments, the fertilizer composition may have an N component of the N-P-K value ranging from 0 to 20, alternatively from 5-15.

Non-limiting examples of a nitrogen source include ammonium nitrate, ammonium sulfate, urea, ammonium phosphate, anhydrous ammonium, and mixtures of the foregoing. In one embodiment, the fertilizer composition may contain 0-1000 grams of a nitrogen source, preferably 0.01-100 grams, more preferably 0.1-10 grams, and most preferably 0.2-0.5 grams.

Non-limiting examples of a phosphorus source include calcium phosphate or a phosphorus-containing acid such phosphorus acid, hypophosphorus acid, polyphosphorous acid, polyhypophosphorus acid, or mixtures thereof. In one embodiment, the fertilizer composition may contain 0-1000 grams of a phosphorus source, alternatively 0.01-100 grams, preferably 0.01-100 grams, more preferably 0.1-10 grams, and most preferably 0.2-0.5 grams.

Non-limiting examples of a potassium source include potassium chloride, potash, or mixtures thereof. In one embodiment, the fertilizer composition may contain 0-1000 grams of a potassium source, preferably 0.01-100 grams, more preferably 0.1-10 grams, and most preferably 0.2-0.5 grams.

The fertilizer composition of the present invention may also contain additional nutrients such as calcium, magnesium, and sulfur from respective sources. The fertilizer compositions of the present invention may also contain micronutrients such as boron, copper, and iron.

Sources of nitrogen, phosphorus, and potassium may be organic, synthetic, or combinations of the foregoing. In one embodiment, the source of the nitrogen, phosphorus, and potassium is synthetic. In an alternative embodiment, it is predominantly synthetic. Without wishing to be bound by theory, synthetic sources of nitrogen, phosphorus, and potassium may be more readily available to plants than organic sources. In one embodiment, an ideal balance between organic and synthetic sources of fertilizer may be provided. The resulting compost from in-home composting may act as an organic source of fertilizer. Supplementing the in-home compost with synthetic sources of fertilizer can provide a balance of readily available and slow release sources of nutrients to plants in the organic waste.

In one embodiment, the fertilizer composition of the present invention includes a lysine source. Non-limiting examples of a lysine source include lysine monohydrochloride, lyside hydrate, lysine dihydrochloride, lysidine sulfate, and combinations of the foregoing. Lysine sources may be obtained commercially from Archer-Daniels-Midland Company, Decatur, Ill.

In one embodiment, the composition contains an alkalinity source or an acidifying source. Alkalinity sources include, but are not limited to, lime and wood ash. Acidifying sources include, but are not limited to, sulfur and aluminum sulfate.

One aspect of the invention includes a composting aid that comprises one or more enzymes to assist in the composting process. The enzymes may be used alone or in combination with composting microbes. Non-limiting examples of enzymes include: cellulases, hemicellulases, peroxides, proteases, gluco-amylases, amylases, xylaneses, lipases, phospholipases, esterases, cutinases, pectinases, keratinases, reductases, oxidases, phenoloxidases, lipoxygenases, lignases, pullulanases, tannases, pentosanases, malanases, β-glucanases, arabinosidases, hyaluronidase, chondroitinase, laccase, or mixtures of the foregoing. In one embodiment, the enzymes include protease, amylase, lipase, peroxidases, cutinase, and/or cellulose in conjunction with one or more plant cell wall degrading enzyme. In another embodiment, the enzymes are at levels from 0.0001% to 2% by weight of the composition.

The composting aid may be provided in desired quantities in a unit dose article. The "unit dose article" may be a packet, a tablet, or a tablet within a packet. The term "packet" includes, but is not limited to, a pouch, capsule, bag, sachet, or the like. The unit dose article may comprise one or more of the compositions of the present invention. The unit dose article may have a single compartment or multiple compartments. With a multiple compartment embodiment, the unit dose article may contain different compositions in each compartment. Incompatible compositions may be separated in different compartments. In one embodiment, the compartments of the multi-compartment article may be superposed to one another.

The compositions of the present invention may be enclosed by materials by conventional methods such as rotating drums, thermoforming, and injection molding.

In one aspect of the present invention, the composting aid may comprise a composting microbe including, but not limited to, bacteria, yeast, mold, fungi/spores/hyphal suspensions, or combinations of the foregoing, and optionally a microbe supplement. The term "microbe supplement" includes microbes, probiotics, antibiotics, biocides, or combinations of the foregoing. A prebiotic is a chemical that selectively encourages the growth of desired microbes and/or discourages the growth of undesired microbes. Non-limiting examples of prebiotics include selective food carbons, sugars such as fructooligosaccharides, certain alcohols (e.g. inositol, mannitol), certain selective essential cations such as iron and vanadium, or cofactors such as hemin or Vitamin K. A probiotic is a desirable microbe that outcompetes and/or selectively inhibits undesirable microbes. A non-limiting example of a probiotic is a bacteria producing lactic acid that inhibits gram negative pathogens. Antibiotics/biocides are natural or chemical agents that act directly on undesirable microbes to inhibit growth of or kill microbes.

The composition containing a composting microbe may be contained in a unit dose article. Microbes can be added to aid in one or more of the following functions: accelerate the onset of aerobic decomposition of food and vegetative wastes; provide malodor control; potentiate high decomposition activity in terms of rate and spectrum of decomposition on a wide range of organic materials, including high cellulose and fibrous plant/paper materials; improve composting hygiene; reinforce the establishment/colonization of bacteria to fuel high intensity aerobic decomposition; raise the temperature of the organic compost material to enable thermophilic decomposition; aid in reducing or eliminating undesired or pathogenic microbes; increase the quality of the final compost (e.g., pH, percentage of humus, moisture retention, bioavailability of micronutrients, and nutrient content); or combinations thereof.

Microbes/supplements can be administered as a solution or liquid suspension, or dry form such as powder. In addition to water, a suspension/solution may contain other ingredients including solvents, dispersing agents, stabilizers, toxicity modifiers, pH buffers etc. Generally, about 1 billion microbial cells are contained per one milliliter of solution/suspension or per one milligram in a dry form.

A listing of microbes may include the following: bacteria of the *Bacillus* genus; *Bacillus smithii* (preferably the Oklin strain); *Bacillus sulfolobus* (preferably the Oklin strain); *Bacillus subtilis; Bacillus licheniformis; Bacillus megaterium; Bacillus polymyxa; Bacillus circulans; Bascillus cereus*; bacteria of the *Lactobacillus* genus; *Lactobacillus acidophilus; Lactobacillus actinomyces; Lactobascillus casei; Lactobacillus Streptomyces; Lactobacillus frankia; Lactobacillus Azobacter*; and combinations of the foregoing.

Microbes may contain fungi, preferably in combination with bacteria. A listing of microbes may include the following: fungi of the *Aspergillus* genus; *Aspergillus niger; Aspergillus orizae*; fungi of the *Rhizopus* genus; fungi of the *Saccaromyces* genus; fungi of the *Trichondema* genus; and combinations of the foregoing.

Examples of supplements may include ingredients to facilitate composting and/or provide better compost. Ingredients that may help facilitate composting include high nitrogen containing components such as soybean and alfalfa (to encourage microbial growth); sawdust (to increase circulation and therefore oxygen content); trace minerals; sugars (e.g., molasses to help fuel microbes); enzymes, and mixtures of the foregoing. Ingredients that may help provide better compost include soil conditioners such as humus and humic leonardite compounds derived from leonardite, rooting hormones, or combinations of the foregoing.

The composting aid of the present invention may also contain a perfume or colorant.

After the user places organic waste and composting aid in the kitchen sink 12, the organic waste and composting aid are then flushed down the sink's drain 20 by the use of water from the faucet 18. The organic waste and composting aid advance through the waste inlet 32 of the waste separator 26 and into the processing chamber 36. The motor-driven cutter 34 is operated to cut, squeeze, and mix the organic waste and composting aid in the processing chamber 36. The cutter 34 may be sensor activated or manually engaged by the user's operation of a switch. Operation of the motor-driven cutter 34 separates (i.e., extracts) the liquid from the organic waste composition. This separated liquid, along with water from the sink 12, is then drained out of the processing chamber 36 and into a residential drain line 38 via the liquid outlet 40. The filter 56 prevents solids from escaping the waste separator 26 through the liquid outlet 40 and into the drain line 38.

The organic pulp generated as a result of extraction of the liquid from the organic waste composition by the waste separator 26 is advanced out of the processing chamber 36 through the pulp outlet 42. The organic pulp then advances through the pulp inlet 44 of the dryer 28 and into its drying chamber 46. The incoming pulp is dispersed into the cavities 52 of the mold(s) 50 within the drying chamber.

The heating elements 48 are then operated to dry the organic pulp so as to generate solid organic waste. The time and temperature to which the organic waste composition is subjected within the drying chamber 46 is either predetermined or actively controlled (e.g., via a sensor-based control scheme) to ensure that the organic waste is sufficiently dehydrated beyond the point to support bacterial decomposition. As a result, the waste is dried sufficiently enough to prevent the organic waste from composting thereby preventing unpleasant odors from being created.

Once sufficiently dehydrated, the dried solid organic waste is advanced out of the drying chamber 46 via the waste outlet 58 and into the removable collection receptacle 30. Prior to being deposited in the removable collection receptacle 30, the dried organic waste may be powderized by use of the grinder 54 thereby generating a dried powder waste which is deposited into the removable collection receptacle 30.

The user may then remove the collection receptacle 30 and dump the collected dried waste in a suitable manner. For example, the dried plugs or powder may be dumped in an outdoor compost location. Gardens and flower beds are particularly useful areas to deposit powder waste. Alternatively, the collected waste may be dumped into a trash receptacle for pickup in the normal way.

Figure 4:
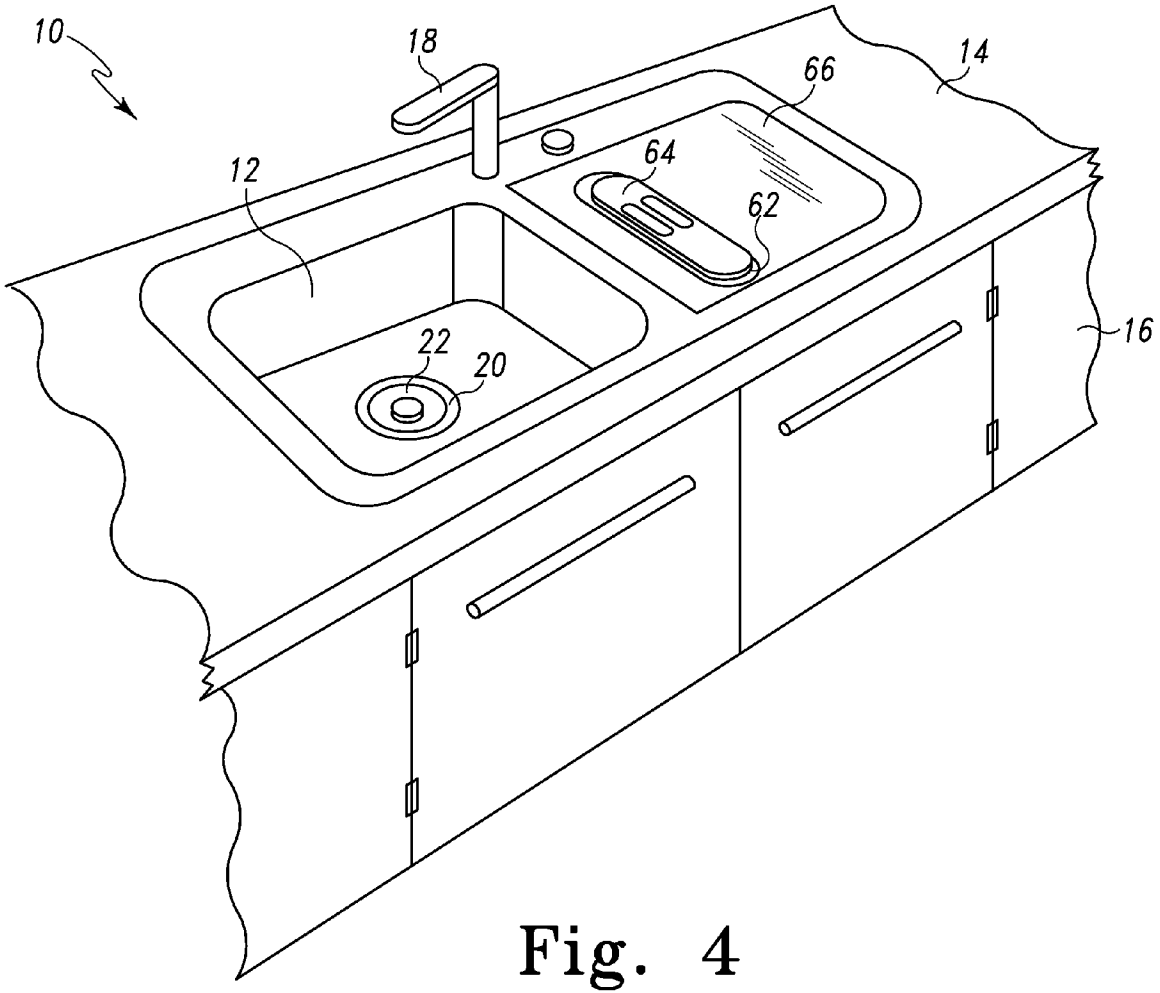
FIG. 4 is view similar to FIG. 1, but showing a second embodiment of a waste processing appliance.
Figure 5:
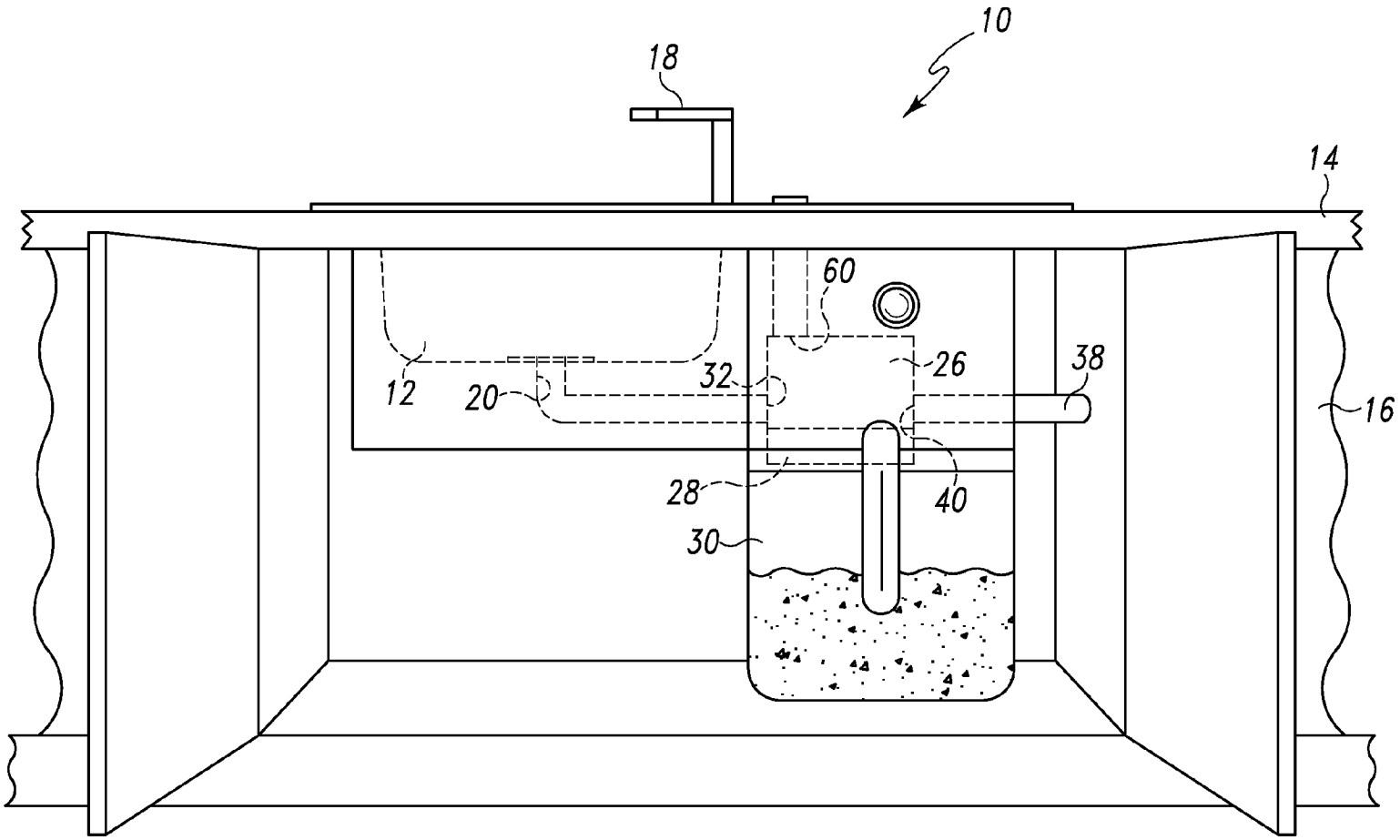
FIG. 5 is a view similar to FIG. 2, but showing the second embodiment of the waste processing appliance.

Referring now to FIGS. 4 and 5, there is shown an alternate embodiment of the waste processing appliance 24. The same reference numerals are used to designate similar components between the embodiment of FIGS. 1-3 and the embodiment of FIGS. 4 and 5. The waste processing appliance 24 of FIGS. 4 and 5 is essentially the same as the design of FIGS. 1-3 with the addition of a counter-top access location for disposing of large amounts of organic waste. In particular, the waste processing appliance of FIGS. 4 and 5 includes a second waste inlet port 60 which is coupled to an elongated waste-receiving slot 62 located on the counter top 14. A sealing cap 64 is positioned in the slot 62 when it is not in use. Large pieces of organic waste, such as large kitchen scraps, may be disposed of through the slot 62 and advanced to the waste separator 26 where they are processed in the same manner as described above in regard to the design of FIGS. 1-3. Organic waste passed through the sink's drain 20 are processed in a similar manner to as described above.

The design of FIGS. 4 and 5 is particularly useful for custom installations. For example, as shown in FIGS. 4 and 5, the disposal slot 62 may be surrounded by a food cutting and/or prep surface 66. Scraps from the cutting/prep process may be easily disposed through the slot 62 without having to be moved to the sink 12. Composting aid may also be introduced through slot 62.

It is also contemplated that the composting aid could be stored in a reservoir or automatic dosing container such that either a user initiates dosing of the composting aid when organic waste is fed to the system, or that the automatic dosing container is activated when the organic waste is advanced through the sink's drain or alternative step in the process.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A method for processing organic waste from a sink, comprising:

advancing organic waste through a drain of the sink and into a waste separator positioned below the kitchen, providing the waste separator with a composting aid, operating a motor-driven cutter positioned in the waste separator to generate pulp and a separated liquid from the organic waste, advancing the pulp from the waste separator to a dryer, draining the separated liquid from the waste separator to a drain via a fluid path which bypasses the dryer, and heating the pulp in the dryer to form a dried solid waste.

2. The method of claim 1, further comprising advancing the dried solid waste into a removable collection receptacle positioned below the dryer.

3. The method of claim 1, wherein heating the pulp comprises heating the pulp in the dryer to form solid waste powder.

4. The method of claim 1, wherein heating the pulp comprises heating the pulp in the dryer to form solid waste plugs.

5. The method of claim 1, wherein operating the motor-driven cutter comprises operating an augur to mix organic waste with the composting aid to produce an organic waste composition.

6. The method of claim 5, wherein operating the motor-driven cutter further comprises cutting and squeezing the organic waste composition to separate liquid therefrom and generate the pulp.

7. The method of claim 1, wherein operating the motor-driven cutter comprises operating one or more centrifugal cutting disks to mix organic waste with the composting aid to produce an organic waste composition and to cut and squeeze the organic waste composition to separate liquid therefrom and generate the pulp.

8. The method of claim 1 wherein providing the waste separator with a composting aid comprises providing the waste separator with from about 0.1 g to about 1,000 g of a composting aid.

9. The method of claim 8 wherein the composting aid comprises from about 0.1 g to about 1,000 g of a nitrogen source.

10. The method of claim 8 wherein the composting aid comprises from about 0.1 g to about 1,000 g of a phosphorus source.

11. The method of claim 8 wherein the composting aid comprises from about 0.1 g to about 1,000 g of a potassium source.

12. The method of claim 1 wherein the composting aid is contained by a biodegradable film.

13. The method of claim 1 wherein the composting aid is in the form of a compressed tablet.

14. A method for processing organic waste from a sink, comprising:

advancing organic waste through a drain of the sink and into a waste separator positioned below the sink, providing the waste separator with a composting aid, operating a motor-driven cutter positioned in the waste separator to generate pulp, advancing the pulp from the waste separator to a dryer, draining the separated liquid from the waste separator to a drain via a fluid path which bypasses the dryer, and heating the pulp in the dryer to form a dried solid waste, wherein the composting aid comprises a first composition and a second composition.

15. The method of claim 14, wherein the composting aid is contained by a biodegradable film.

16. The method of claim 15, wherein the first composition is contained by a film to form a first compartment and the second composition is contained by a film to form a second compartment.

17. The method of claim 16, wherein the composting aid comprises an ingredient selected from the group consisting of from about 0.1 g to about 1,000 g of a nitrogen source; from about 0.1 g to about 1,000 g of a phosphorus source; and from about 0.1 g to about 1,000 g of a potassium source.

18. The method of claim 17, wherein the second composition comprises activated carbon.

19. The method of claim 17, wherein the second composition comprises a component selected from the group consisting of: a composting microbe, a microbe supplement, and a combination of the foregoing.

* * * * *